US006693617B2

(12) United States Patent
Sasaki et al.

(10) Patent No.: US 6,693,617 B2
(45) Date of Patent: Feb. 17, 2004

(54) LIQUID CRYSTAL DISPLAY APPARATUS AND DATA DRIVER

(75) Inventors: Osamu Sasaki, Tenri (JP); Kouji Kumada, Tenri (JP); Yutaka Takafuji, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/782,527

(22) Filed: Feb. 13, 2001

(65) Prior Publication Data

US 2001/0022573 A1 Sep. 20, 2001

(30) Foreign Application Priority Data

Mar. 16, 2000 (JP) ..... 2000-074758

(51) Int. Cl.[7] ..... G09G 3/36
(52) U.S. Cl. ..... 345/98; 345/100
(58) Field of Search ..... 345/100, 99, 98, 345/208, 87, 94

(56) References Cited

U.S. PATENT DOCUMENTS 6,211,849 B1 * 4/2001 Sasaki et al. ..... 345/55
6,294,441 B1 * 9/2001 Yamazaki ..... 438/486

FOREIGN PATENT DOCUMENTS

| | | |
|---|---|---|
| JP | 05-297834 | 11/1993 |
| JP | 06-105263 | 4/1994 |
| JP | 07-077951 | 3/1995 |
| JP | 11-175019 | 7/1999 |
| JP | 11-271811 | 10/1999 |
| JP | 11-272226 | 10/1999 |
| JP | 11-338439 | 12/1999 |

* cited by examiner

*Primary Examiner*—Dennis-Doon Chow
(74) *Attorney, Agent, or Firm*—David G. Conlin; William J. Daley, Jr.; Edwards & Angell, LLP

(57) ABSTRACT

A liquid crystal display apparatus and a data driver of the present invention is provided with a sampling pulse generating circuit. The sampling pulse generating circuit is provided with a shift register for shift operation having a plurality of set-reset type flip-flops, and analog switches whose opening and closing of each analog switch is controlled in response to each output of the respective flip-flops so that a clock signal is outputted during the opening as a sampling pulse. Sampling of the image signal is carried out in accordance with the sampling pulses. The pulse width of the sampling pulse varies depending on the duty ratio of the clock signal, thereby ensuring to avoid that active periods of the adjoining sampling pulses overlap with each other.

10 Claims, 13 Drawing Sheets

LIQUID CRYSTAL DISPLAY APPARATUS AND DATA DRIVER

FIELD OF THE INVENTION

The present invention relates to a liquid crystal display apparatus and a data driver having a sampling pulse generating circuit that generates a plurality of sampling pulses for carrying out the sampling of an inputted signal in accordance with an inputted clock signal.

BACKGROUND OF THE INVENTION

FIG. 5 shows an example of a conventional driver monolithic-type liquid crystal display apparatus. As shown in FIG. 5, there are provided, on a transparent substrate such as a glass substrate and a quartz substrate, a data driver 101, a gate driver 102, and a display section 103, thereby constituting a driver monolithic-type liquid crystal display apparatus.

To the data driver 101, are inputted a start pulse sp (control signal), clock signals ck and ckb, and video signals 1 and 2 (image signals), respectively.

To the gate driver 102, are inputted signals such as a start pulse spg and clock signals ckg and ckgb. The display section 103 is constituted by thin film transistors (TFT) 104 in a matrix manner. The gate terminals of the respective thin film transistors 104, constituting the display section 103, are connected to gate bus lines G1, G2, . . . , Gn that are extended from the respective outputs of the gate driver 102. The source terminals of the respective thin film transistors 104 are connected to source bus lines ①, ②, . . . , n that are extended from the respective outputs of the data driver 101. The drain terminals of the respective thin film transistors 104 are connected to pixel capacitors 105 (pixel capacity) formed by transparent electrodes and opposite electrodes.

As shown in FIG. 6, the data driver 101 is constituted by a sampling pulse generating circuit 201 and analog switches 202 for sampling the image signals (the video signals 1 and 2 (inputted signals)) that were inputted into the data driver 101.

The sampling pulse generating circuit 201, as shown in FIG. 7(*a*), is constituted by (1) a shift register having a plurality of D-type flip-flops 301 that are cascade connected with each other and (2) AND circuits 302 for carrying out the operation of logical product with respect to the respective adjoining D-type flip-flops 301. The adjoining outputs (adjoining two outputs among the outputs Q1 through Q5 in FIG. 7(*a*)) of the respective stages of the shift register are inputted into the corresponding AND circuit 302.

The following explanation deals with the operation of the conventional liquid crystal display apparatus. Upon receipt of the start pulse sp, and the clock signals ck and ckb, the sampling pulse generating circuit 201, as shown in a timing chart of FIG. 7(*b*), consecutively outputs the first stage output SAM1, the second stage output SAM2, the third stage output SAM3, . . . , respectively, these outputs being sampling pulses.

To the sampling pulse generating circuit 201, at the timing shown in FIG. 8, are inputted the video signals 1 and 2 (image signals) that are the image signals obtained by being subject to time base extension in which the original image signals are twice time-base-extended. In accordance with the first stage output SAM1, the second stage output SAM2, the third stage output SAM3, . . . , the display image data are written into the source bus line capacitor through a sample hold circuit composed of the analog witches 202 and hold capacitor (capacity) formed by the source bus lines ①, ②, . . . , n that constitute the display section 103.

While writing the display image data into the respective source bus lines ①, ②, . . . , n in accordance with the sampling pulses, i.e., the first stage output SAM1, the second stage output SAM2, the third stage output SAM3, . . . , the gate bus line Gn (the output of the gate driver) is active, thereby the data, written into the respective source bus lines ①, ②, . . . , n through the thin film transistors 104 that are connected to the gate bus line Gn, are consecutively stored into the pixel capacitors 105 constituting the display section 103. Then, the sampling is finished with respect to the image data that correspond to the amount of one horizontal period. After having finished the writing of the data into the pixel capacitors 105, the gate bus line Gn becomes non-active. Until the display image data that correspond to the amount of the next frame period, the image data, written into the pixel capacitors 105, is maintained, thereby carrying out the image display of the liquid crystal display apparatus.

When carrying out the sampling of the image data in accordance with the foregoing operations, the actual sampling pulses outputted from the sampling pulse generating circuit 201 (for example, in the case of FIG. 6, the sampling pulses correspond to the first stage output SAM1, the second stage output SAM2, the third stage output SAM3, and the fourth stage output SAM4) have blunt wave forms, as shown in FIG. 9, due to additional capacity such as gate capacity of the analog switch 202 to be driven. When the sampling pulse becomes blunt, there occurs time Tob during which the n-th stage output SAMn overlaps with the (n+1)-th stage output SAMn+1.

In the case where the sampling of the image data is carried out, the data at the time when the sampling pulse turns off is written into the hold capacitor (in the case of the liquid crystal display apparatus, the hold capacitor correspond to the capacitor formed by the source bus lines). At this time, prior to the time Tob just before the n-th stage output SAMn perfectly turns off, the (n+1)-th stage output SAMn+1 turns on, thereby causing a noise in the image data to occur due to the charging and discharging of the source bus line capacitor. This results in that the appropriate sampling of the image data can not be carried out.

In order to overcome the foregoing problem, the following arrangement is proposed (see FIG. 10). As shown in FIG. 10, the logical product operation is carried out by an AND circuit 603 with respect to each stage output of the sampling pulse generating circuit 201 and a signal that is obtained by delaying the above-mentioned each stage output so as to narrow the pulse width of each stage output. More specifically, the n-th stage AND circuit 603 carries out the logical product operation with respect to the n-th stage output SAMn and a signal outputted from the n-th stage delay circuit 602 delaying the n-th stage output SAMn so as to narrow the pulse width of the n-th stage output SAMn.

With the foregoing arrangement, as shown in FIG. 11 after the n-th stage AND circuit 603 carries out the logical product operation with respect to the n-th stage output SAMn and the delayed signal SAMdn outputted from the n-th stage delay circuit 602, the resultant signal SAMn' thus subject to the logical product operation is outputted as the n-th stage output from the sampling pulse generating circuit 201. Similarly, after the (n+1)-th stage AND circuit 603 carries out the logical product operation with respect to the (n+1)-th stage output SAMn+1 and the delayed signal SAMdn+1' outputted from the (n+1)-th stage delay circuit 602, the resultant signal SAMn+1' thus subject to the logical product operation is outputted as the (n+1)-th stage output from the sampling pulse generating circuit 201.

Since the time duration (Td1 through Td4 in FIG. 11) is provided for each stage output (sampling pulse), it is avoidable that the adjoining outputs SAMn' and SAMn+1' overlap with each other, thereby reducing the noise occurred in the image data.

As shown in FIG. 12, another conventional arrangement is proposed so as to narrow the pulse width of the sampling pulse (see the timing chart of FIG. 13), in which a delay circuit 803 for delaying the clock signal ck, a delay circuit 802 for delaying the clock signal ckb, and an AND circuit 804 for carrying out the logical product operation with respect to each stage output from the sampling pulse generating circuit 201 and either one of the output of the delay circuit 802 or 803.

Here, with reference to the timing chart shown in FIG. 11, the following explanation deals with more specific operations as to how to narrow the pulse width of the sampling pulse of the data driver having an arrangement shown in FIG. 10.

The n-th delay circuit 602 delays, by the delaying amount of Tdn, the n-th stage output SAMn of the sampling pulse generating circuit 201. Thus, the pulse width of the sampling pulse is narrowed by the delaying amount of Tdn. Accordingly, it is not preferable to set too much the delaying amount of Tdn. Because of this, it is likely that the adjoining outputs SAMn' and SAMn+1' overlap with each other when the delaying amount Td1, Td2, . . . of each delay circuit 602 is not uniform due to the fact that the characteristics of the thin film transistors constituting each delay circuit 602 are not uniform or other fact. This results in that it becomes impossible to carry out the sampling of the image data with accurate timing without being affected by some noises.

Furthermore, when controlling the sampling pulse width with the delay circuit 602 for each stage of the sampling pulse generating circuit 201, it is necessary to prepare the delay circuits 602 and AND circuits 603, such that the number of these circuits 602 and 603 is the same as the number of the required sampling pulses. As a result the packaging (mounting) area for the sampling pulse generating circuit 201 becomes increased.

According to the arrangement of the data driver shown in FIG. 12, the delay circuits 802 and 803, instead of the delay circuit 602, are provided in the inputting section of the data driver. Unlike the case of FIG. 10, this ensures that the sampling timing becomes uniform even though the characteristics of the respective delay circuits 602 are not uniform.

However, the load to be driven by the output of the delay circuit 802 is equal to the sum of the input load capacity of the (2k+1)-th (k=0, 1, 2, - . . . ) stage AND circuit 804. Similarly, the load to be driven by the output of the delay circuit 803 is equal to the sum of the input load capacity of the 2k-th (k=0, 1, 2, - - - ) stage AND circuits 804. This causes the problem that the delay circuits 802 and 803 must drive a heavy load, respectively.

Moreover, in the case of the arrangement shown in FIG. 12, unlike the case of the arrangement shown in FIG. 10, it is not necessary to provide the delay circuits 602 for each stage of the sampling pulse generating circuit 201. However, it is necessary to provide the AND circuits 804 whose number is identical with the required sampling pulses, thereby causing the packaging area to become large for realizing the data driver.

Note that Japanese unexamined patent publication No. 5-297834 (Publication Date: Nov. 12, 1993), Japanese unexamined patent publication No. 6-105263 (Publication Date: Apr. 15, 1994), and Japanese unexamined patent publication No. 11-175019 (Publication Date: Jul. 2, 1999) disclose the following technique. More specifically, by considering a delay of image signal due to the distributed constant of transmission lines for video signals and adjusting the phase of shift clock for driving the data driver in accordance with such a delay, the sampling timing of the image signal is adjusted so as to be coincident with the adequate point of the image data, thereby ensuring the sampling of image data with accuracy, which is the object of the techniques disclosed in the foregoing Japanese unexamined patent publications.

SUMMARY OF THE INVENTION

It is an object of the present invention to avoid active periods of respective adjoining sampling pulses overlapping with each other so as to reduce an error that occurs in image data during sampling, which is different from the foregoing publications.

In order to achieve the foregoing object, a liquid crystal display apparatus in accordance with the present invention having a sampling pulse generating circuit for generating a plurality of sampling pulses that carry out sampling of inputted signal, in which the inputted signal is sampled in accordance with the sampling pulse so as to be written into a display section as a display data is characterized by having the following arrangement.

More specifically, in the liquid crystal display apparatus, the sampling pulse generating circuit generates the sampling pulses in accordance with a clock signal whose duty ratio of a high level period with respect to a low level period is less than 50 percent.

With the arrangement of the liquid crystal display apparatus, the sampling pulse is generated by the sampling pulse generating circuit and inputted signal to be displayed in accordance with the sampling pulse is sampled, and the sampling result is written into the display section as the display data so that the display section displays the inputted signal.

The wave form of the sampling pulse is blunt due to such as the additional capacity formed by such as devices (elements) to be driven and wirings through which the sampling pulse is transmitted. This causes the following problem. More specifically, in the case where the duty ratio of the sampling pulse to be generated is fixed to 50 percent, there occurs the period in which the adjoining sampling pulses overlap with each other in the vicinity of the edges (the rising-up edges and falling-down edges). As a result, the sampling of the inputted signal can not be carried out with accuracy, and the sampling result contains an error, thereby causing that the accurate display data is not written into the display section.

In order to overcome the problem, a variety of proposals have been proposed in which the pulse width of the sampling pulse that has been generated is narrowed. However, in such proposals, the number of the circuit elements require such as a delay circuit and an AND circuit for controlling the pulse width of the sampling pulse, is as many as the number of the sampling pulses. This causes the packaging (mounting) area of the sampling pulse generating circuit to increase. Further, in the case where the delay circuit is provided, the delay circuit is required to have the driving ability in accordance with the number of the sampling pulses.

As the conventional arts other than the foregoing ones, it is known that a delay due to the distributed constant of transmission lines for the inputted signal is considered and the phase of shift clock for driving the data driver is adjusted in accordance with such a delay so as to avoid the foregoing overlapping. Such a case, however, causes changes the circuit arrangement and operation control to become very complicated.

In contrast, according to the liquid crystal display apparatus of the present invention, the sampling pulse is generated in accordance with the clock signal whose duty ratio of a high level period with respect to a low level period is less than 50 percent. More specifically, when the duty ratio of a high level period with respect to a low level period of the clock signal is less than 50 percent, it is avoidable that the adjoining sampling pulses which are generated by the sampling pulse generating circuit overlap with each other. Since this allows the sampling of the inputted signal is carried out with accuracy, it is avoided that the sampling result has an error, thereby allowing the accurate display data to be written into the display section. Accordingly, without making the circuit arrangement and operation control complicated, and without considering the driving ability of the delay circuit, a liquid crystal display apparatus with extremely high display reliability can be realized.

In order to achieve the foregoing object, a data driver in accordance with the present invention having a sampling pulse generating circuit for generating a plurality of sampling pulses that carry out sampling of inputted signal, in which the inputted signal is sampled in accordance with the sampling pulse so as to be outputted as a display data is characterized by having the following arrangement.

More specifically, in the data driver, the sampling pulse generating circuit generates the sampling pulse in accordance with a clock signal whose duty ratio of a high level period with respect to a low level period is less than 50 percent.

With this arrangement of the data driver, the sampling pulse is generated by the sampling pulse generating circuit, an inputted signal to be displayed in accordance with the sampling pulse is sampled, and the sampling result is written into the display section as the display data.

The wave form of the sampling pulse is blunt due to such as the additional capacity formed by such as devices (elements) to be driven and wirings through which the sampling pulse is transmitted. This causes the following problem. More specifically, in the case where the duty ratio of the sampling pulse to be generated is fixed to 50 percent, there occurs the period in which the adjoining sampling pulses overlap with each other in the vicinity of the edges. As a result, the sampling of the inputted signal can not be carried out with accuracy, and the sampling result contains an error, thereby causing accurate display data not to be written into the display section.

In order to overcome the problem, a variety of proposals have been proposed in which the pulse width of the sampling pulse that has been generated is narrowed. However, in such proposals, the number of the circuit elements required, such as a delay circuit and an AND circuit for controlling the pulse width of the sampling pulse, is as many as the number of the sampling pulses. This causes the mounting area of the sampling pulse generating circuit to increase. Further, in the case where the delay circuit is provided, the delay circuit is required to have the driving ability in accordance with the number of the sampling pulses.

As the conventional arts other than the foregoing ones, it is known that a delay due to the distributed constant of transmission lines for the inputted signal is considered and the phase of shift clock for driving the data driver is adjusted in accordance with such a delay so as to avoid the foregoing overlapping. Such a case, however, causes the circuit arrangement and operation control to become very complicated.

In contrast, according to the data driver of the present invention, the sampling pulse is generated in accordance with the clock signal whose duty ratio of a high level period with respect to a low level period is less than 50 percent.

More specifically, when the duty ratio of the clock signal of a high level period with respect to a low level period is less than 50 percent, it is avoidable that the adjoining sampling pulses which are generated by the sampling pulse generating circuit overlap with each other. Since this allows the sampling of the inputted signal to be carried out with accuracy, it is avoided that the sampling result has an error, thereby allowing accurate display data to be written into the display section. Accordingly, without making the circuit arrangement and operation control complicated, and without considering the driving ability of the delay circuit, it a liquid crystal display apparatus with extremely high display reliability can be realized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. The present invention will become more fully understood from the detailed description given hereinbelow and the accompanying drawings which are given by way of illustration only, and thus, are not limitative of the present invention.

DESCRIPTION OF THE EMBODIMENTS

The following description with reference to FIGS. 1 through 4, deals with one embodiment of a sampling pulse generating circuit of a data driver of a liquid crystal display apparatus in accordance with the present invention.

Figure 6:
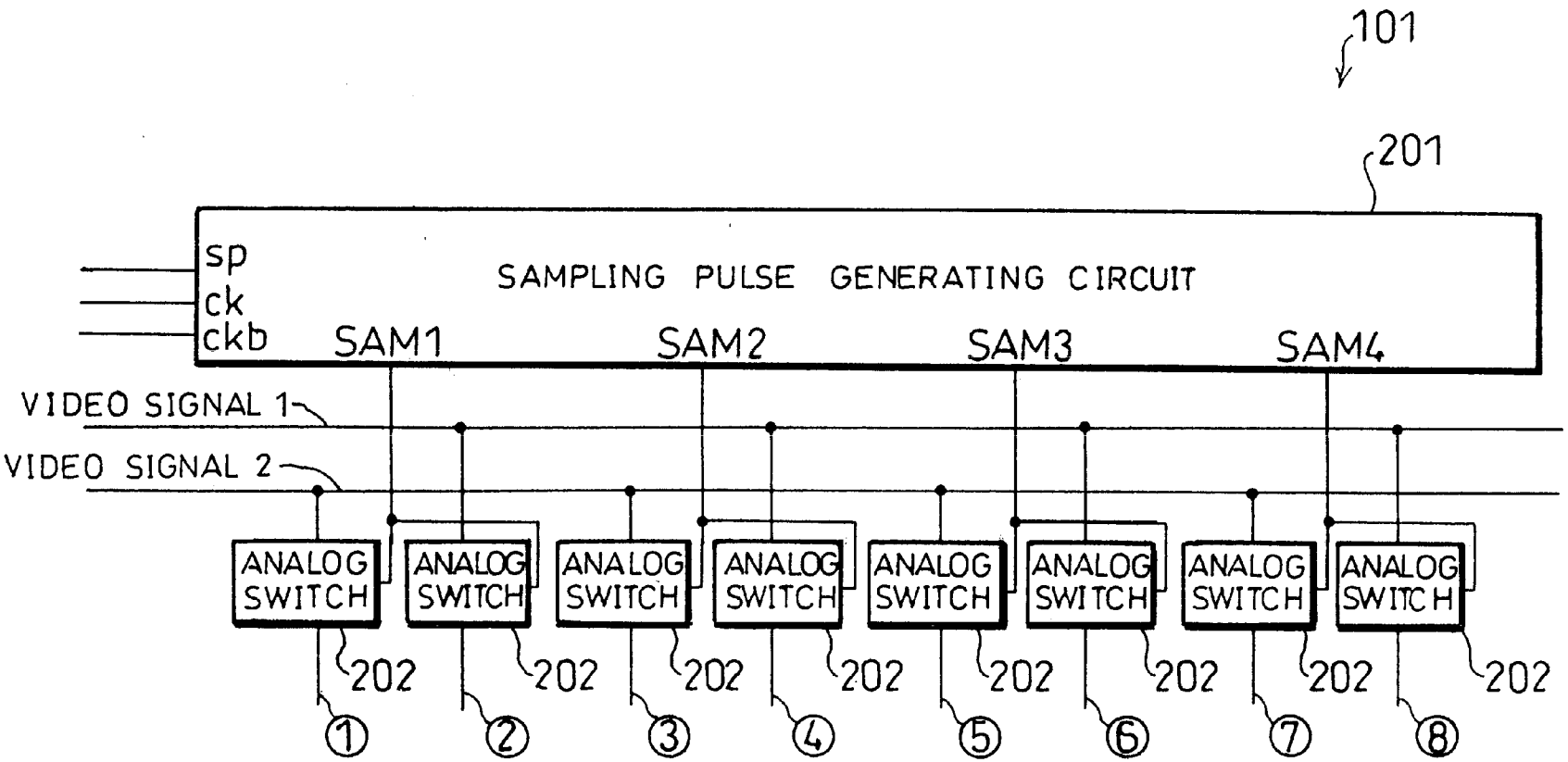
FIG. 6 PRIOR ART
FIG. 6 is a schematic block diagram showing a data driver of liquid crystal display apparatus in accordance with the present invention and the conventional technique.

The arrangement of the data driver has a similar structure to that shown in FIG. 6 but its sampling pulse generating circuit 201 is different from that of the conventional one. The following describes the operation of the sampling pulse generating circuit 201 of the data driver in accordance with the present invention.

Figure 1A:
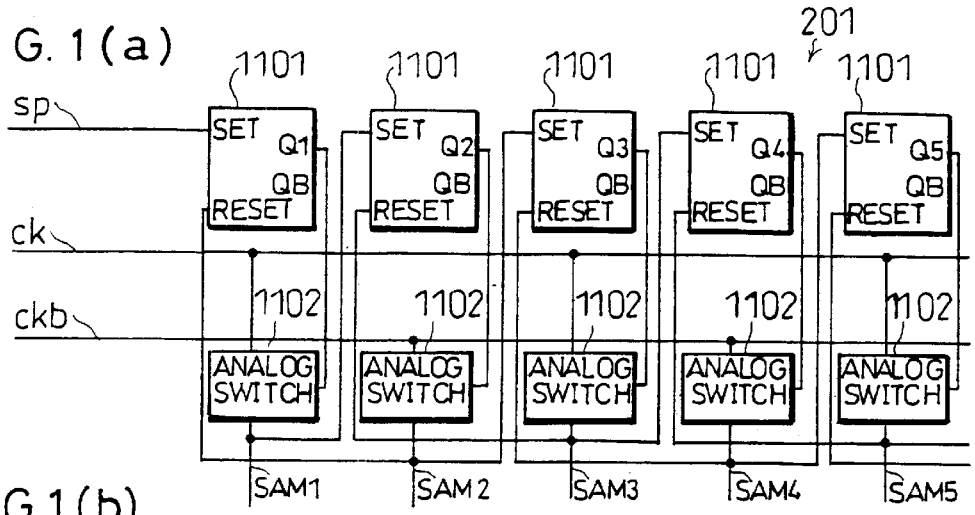
FIG. 1(*a*) is a schematic block diagram showing a sampling pulse generating circuit of a liquid crystal display apparatus in accordance with the present invention, and FIG. 1(*b*) is a timing chart showing the timings of the main portions of FIG. 1(*a*).
Figure 1B:
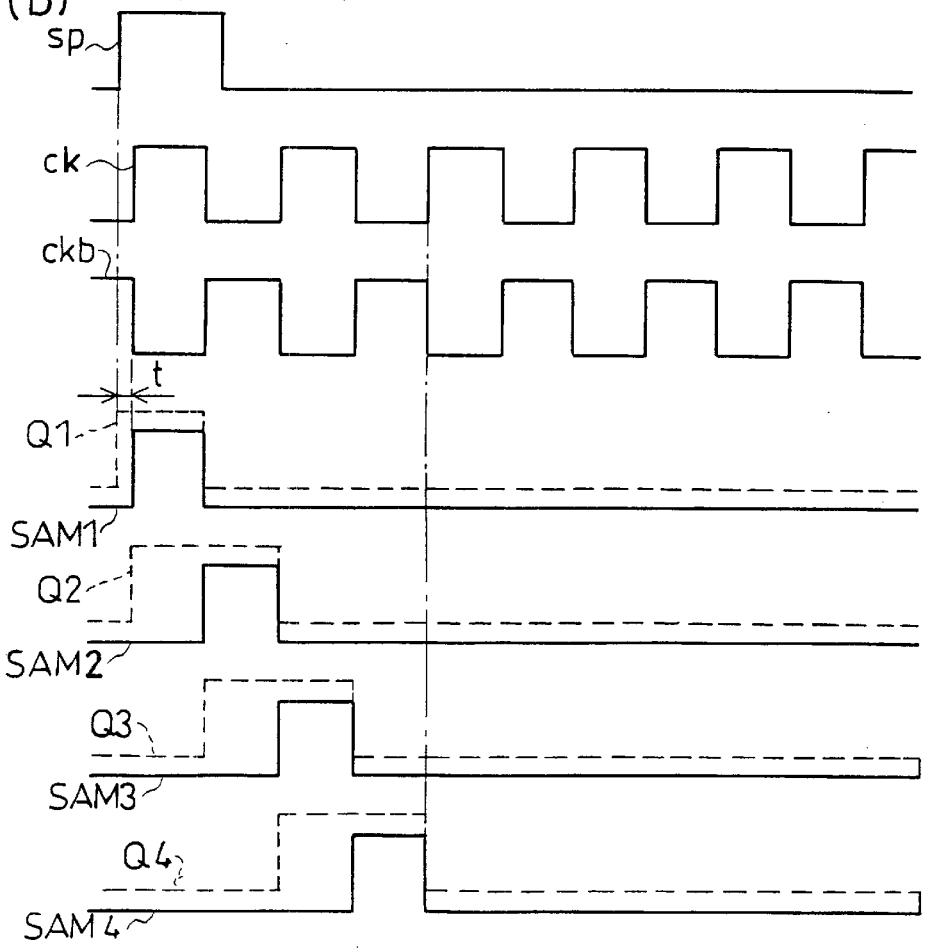

The sampling pulse generating circuit 201 has the structure shown in FIG. 1(*a*). More specifically, the sampling pulse generating circuit 201 is provided with set-reset type flip-flop circuits 1101, and analog switches 1102 for turning on or off in accordance with output Qn (control signal, in the case of FIG. 1(*a*), n is 1, 2, 3, 4, or 5) of the flip-flop circuit 1101 upon receipt of clock signals ck or ckb for driving the sampling pulse generating circuit 201, and the output Qn of the flip-flop circuit 1101 of each stage is connected with a control terminal of the analog switch 1102 of each stage.

In FIG. 1(*a*), the clock signal ck is inputted to the input terminals of the respective odd-numbered analog switches 1102 and the clock signal ckb is inputted to the input terminals of the respective even-numbered analog switches 1102. N-th stage output SAMn (sampling pulse) is outputted from the n-th stage analog switch 1102 and is sent (1) to a set terminal of the next stage, i.e., the (n+1)-th stage flip-flop circuit 1101 and (2) to a reset terminal of the previous stage, i.e., the (n−1)-th stage flip-flop circuit 1101, respectively.

As shown in the timing chart of FIG. 1(*b*), when a start pulse sp is inputted to the first stage flip-flop circuit 1101 constituting the sampling pulse generating circuit 201, the output terminal Q1 of the first stage flip-flop circuit 1101 is set to Hi level as shown in a broken line of FIG. 1(*b*). Since the Hi level of the output terminal Q1 is applied to the control signal input terminal of the first stage analog switch 1102, the clock signal ck at that time is outputted, through the first stage analog switch 1102, as the first stage output SAM1 of the sampling pulse generating circuit 201.

After time t is elapsed since the start pulse sp became Hi level, the clock signal changes from Low level into Hi level, thereby outputting the first stage output SAM1 as shown in FIG. 1(*b*). Further, the first stage output SAM1 of the sampling pulse generating circuit 201 sets the next stage flip-flop circuit 1101, thereby allowing the output terminal Q2 to become Hi level. When the output Q2 is set to Hi level, the second stage analog switch 1102 turns on, the clock signal ckb at that time is outputted, through the second stage analog switch 1102, as the second stage output SAM2 of the sampling pulse generating circuit 201.

When the clock signal ckb changes from Low level into Hi level, thereby outputting the second stage output SAM2 as shown in FIG. 1(*b*). At that time, since the clock signal ck changes from Hi level into Low level, the first stage output SAM1 also changes from Hi level into Low level.

Further, since the second stage output SAM2 is connected with the reset terminal of the previous stage, i.e., the first stage flip-flop circuit 1101, the first stage flip-flop circuit 1101 is reset and the output terminal Q1 again changes from Hi level into Low level. In response thereto, the first stage analog switch 1102 that has turned on turns off. This Low level is maintained until the first stage analog switch 1102 turns on next time.

Similarly, the turning on/off of the n-th stage analog switch 1102 is controlled in accordance with the signal of the output terminal Qn of the n-th stage flip-flop circuit 1101 so that the n-th stage output SAMn is outputted through the n-th stage analog switch 1102. And, the output terminals Qn−1 and Qn+1 of the adjoining stage flip-flop circuits 1101 are controlled to be set or reset in accordance with the n-th stage output SAMn, thereby ensuring that the (n+1)-th stage output SAMn+1, the (n+2)-th stage output SAMn+2, . . . are consecutively outputted.

Due to the foregoing operation, load capacity of the clock signal is only (a) input capacity of the set and reset terminals of the flip-flop circuits 1101 which are located before and after the analog switch 1102 that has turned on and (b) the wiring capacity of the wire that transmits the clock signal. This ensures that the load capacity of the clock signal is reduced as compared with the conventional one, accordingly.

According to the arrangement shown in FIG. 1(*a*), when the n-th stage output SAMn is blunt, like the conventional case, there occurs time Tob (not shown) during which the n-th stage output SAMn overlaps with the (n+1)-th stage output SAMn+1 in the vicinity of the falling and rising edges. This causes that there occurs some noises in the image data due to the charging and discharging of the source bus line capacity n+1, thereby presenting the problem that it is not possible to appropriately carry out the sampling of the image data.

Figure 2:
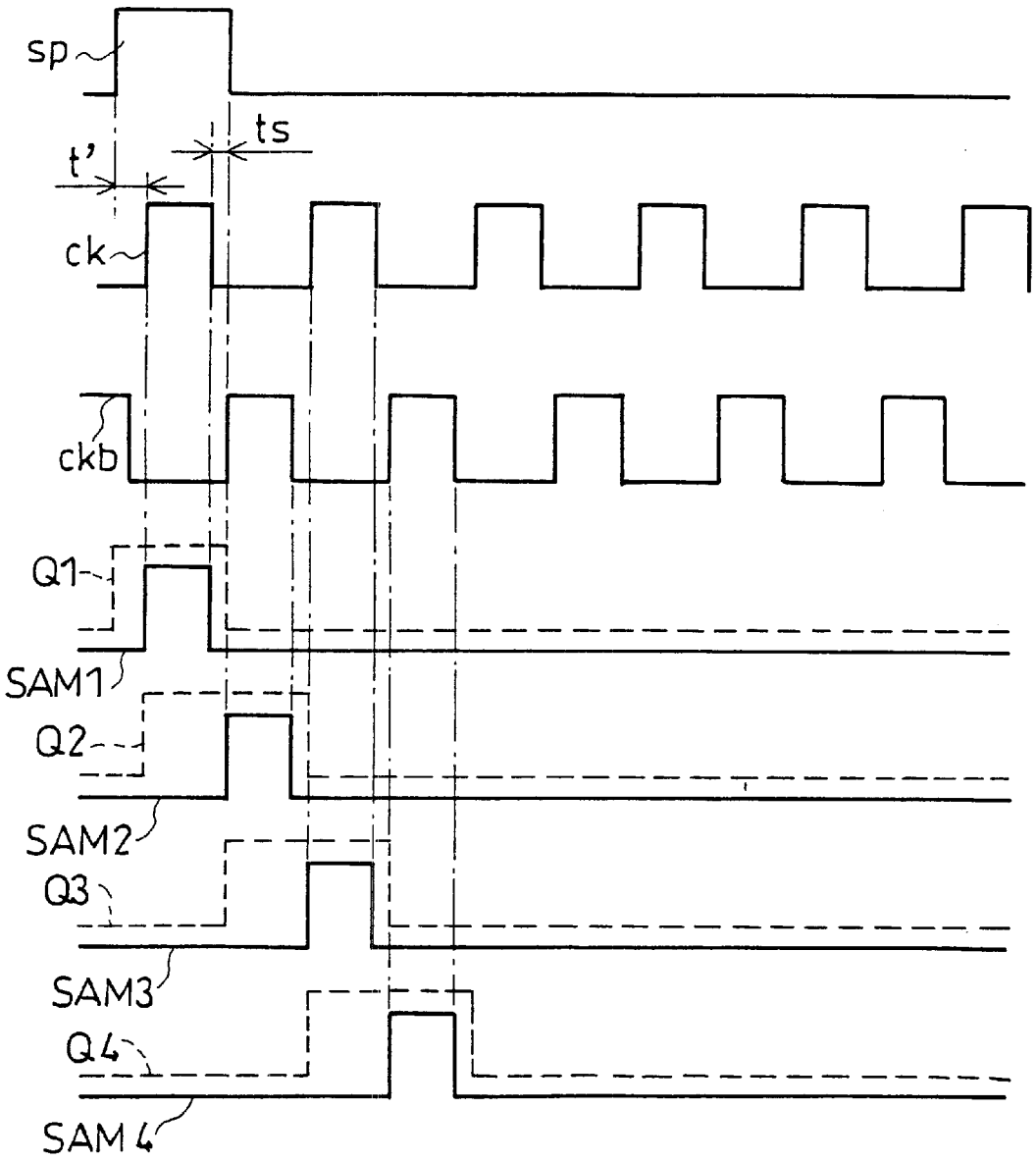
FIG. 2 is a timing chart showing the operations of the sampling pulse generating circuit of the liquid crystal display apparatus.

With reference to the timing chart of FIG. 2, the following explanations deal with how the output terminal Qn and the n-th stage output SAMn behave, respectively, when the start pulse sp, the clock signal ck, the clock signal ckb are inputted to the sampling pulse generating circuit 201 of FIG. 1(*a*) at the timing shown in FIG. 2.

As shown in FIG. 2, the clock signals ck and ckb (driving clocks) of the sampling pulse generating circuit 201 has the duty ratio of less than 50 percent. More specifically, the duration (the sampling pulse width) of the Hi level is shorter than that of the Low level, and time duration ts is provided between the Hi level duration of the clock signal ck and the Hi level duration of the clock signal ckb.

In such a case, when the start pulse sp is inputted to the set terminal (SET) of the first stage flip-flop circuit 1101 constituting the sampling pulse generating circuit 201, the output terminal Q1 of the first stage flip-flop circuit 1101 is set to Hi level as shown in the broken line of FIG. 2. Since the output terminal Q1 is connected with the control terminal of the first stage analog switch 1102, the first stage analog switch 1102 turns on, and the clock signal ck at that time is outputted, through the first stage analog switch 1102, as the first stage output SAM1.

As shown in FIG. 2, the clock signal ck changes from Low level into Hi level after time t' is elapsed since the start pulse sp became Hi level. At this timing, the first stage output SAM1 is outputted, accordingly. Further, the first stage output SAM1 allows the second stage flip-flop circuit 1101 to be set, thereby resulting in that the output terminal Q2 becomes Hi level. In response to the Hi level of the output terminal Q2, the second stage analog switch 1102 turns on, and the clock signal ckb at that time is outputted, through the second stage analog switch 1102, as the second stage output SAM2.

In such a case, in response to the changing of the clock signal ckb from Low level into Hi level, the second stage output SAM2 is outputted. The second stage output SAM2 is outputted to the reset terminal (RESET) of the first stage flip-flop circuit 1101, thereby allowing the first stage flip-flop circuit 1101 to be reset. In response thereto, the output terminal Q1 changes from Hi level into Low level, thereby allowing the control terminal to be supplied with Low level so that the first stage analog switch 1102 changes from turning on into off.

As mentioned above, since the time duration ts (see FIG. 2) is provided between the Hi level duration of the clock signal ck and the Hi level duration of the clock signal ckb, the time ts before the second stage output SAM2 changes from Low level into Hi level, it is possible for the first stage output SAM1 to change from Hi level into Low level. Similarly, since the n-th stage output SAMn of the sampling pulse generating circuit 201 is always outputted so as to keep the time ts before the (n+1)-th stage output SAMn+1 changes from Low level into Hi level, it is possible to avoid the deficiency that the n-th stage output SAMn overlaps with the (n+1)-th stage output SAMn+1.

Figure 7A:
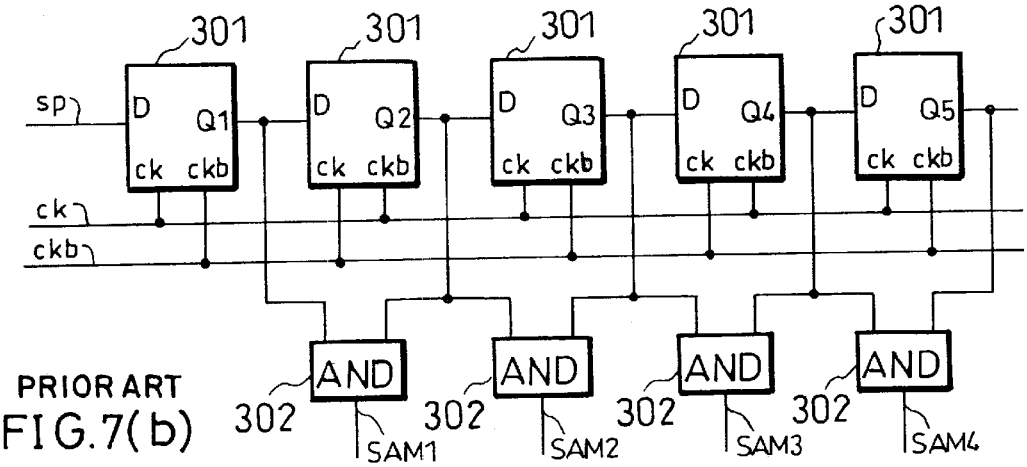
FIG. 7(a) PRIOR ART
FIG. 7(*a*) is a schematic block diagram showing a conventional sampling pulse generating circuit of a liquid crystal display apparatus, and FIG. 7(*b*) is a timing chart showing the timings of the main portions of FIG. 7(*a*).
Figure 7B:
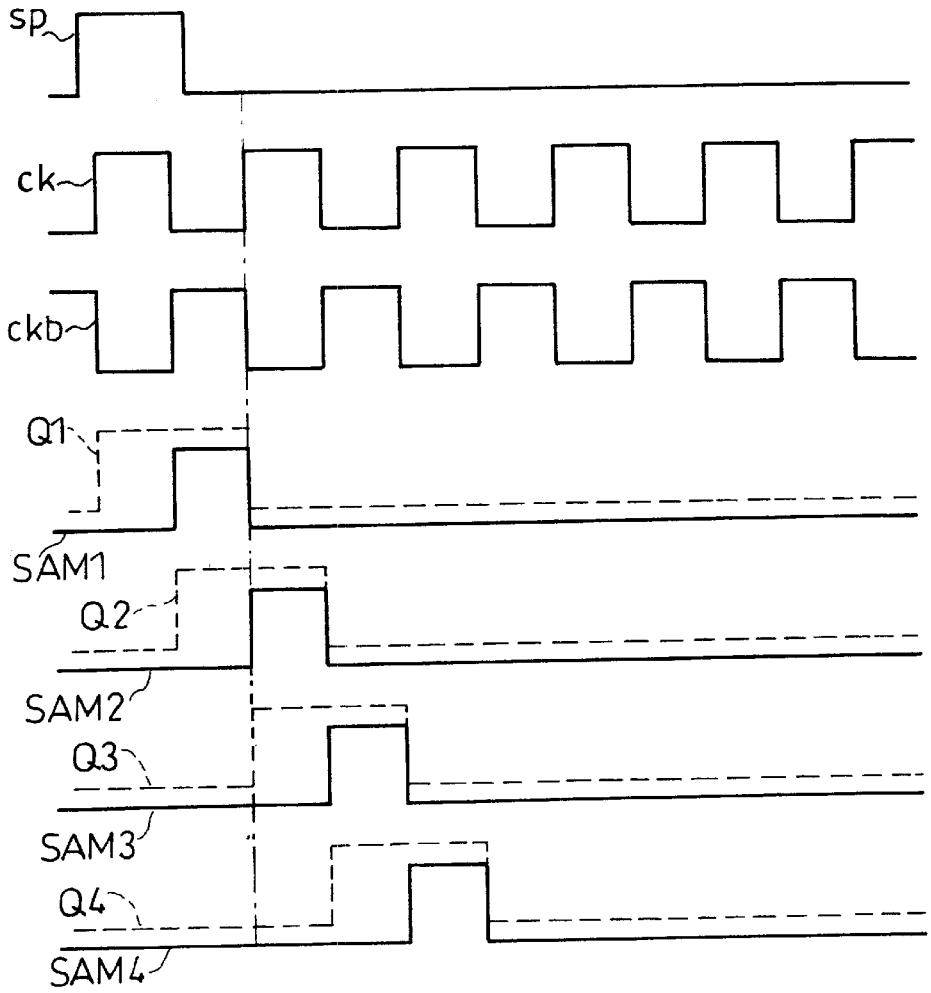
PRIOR ART FIG.7(b)
Figure 8:
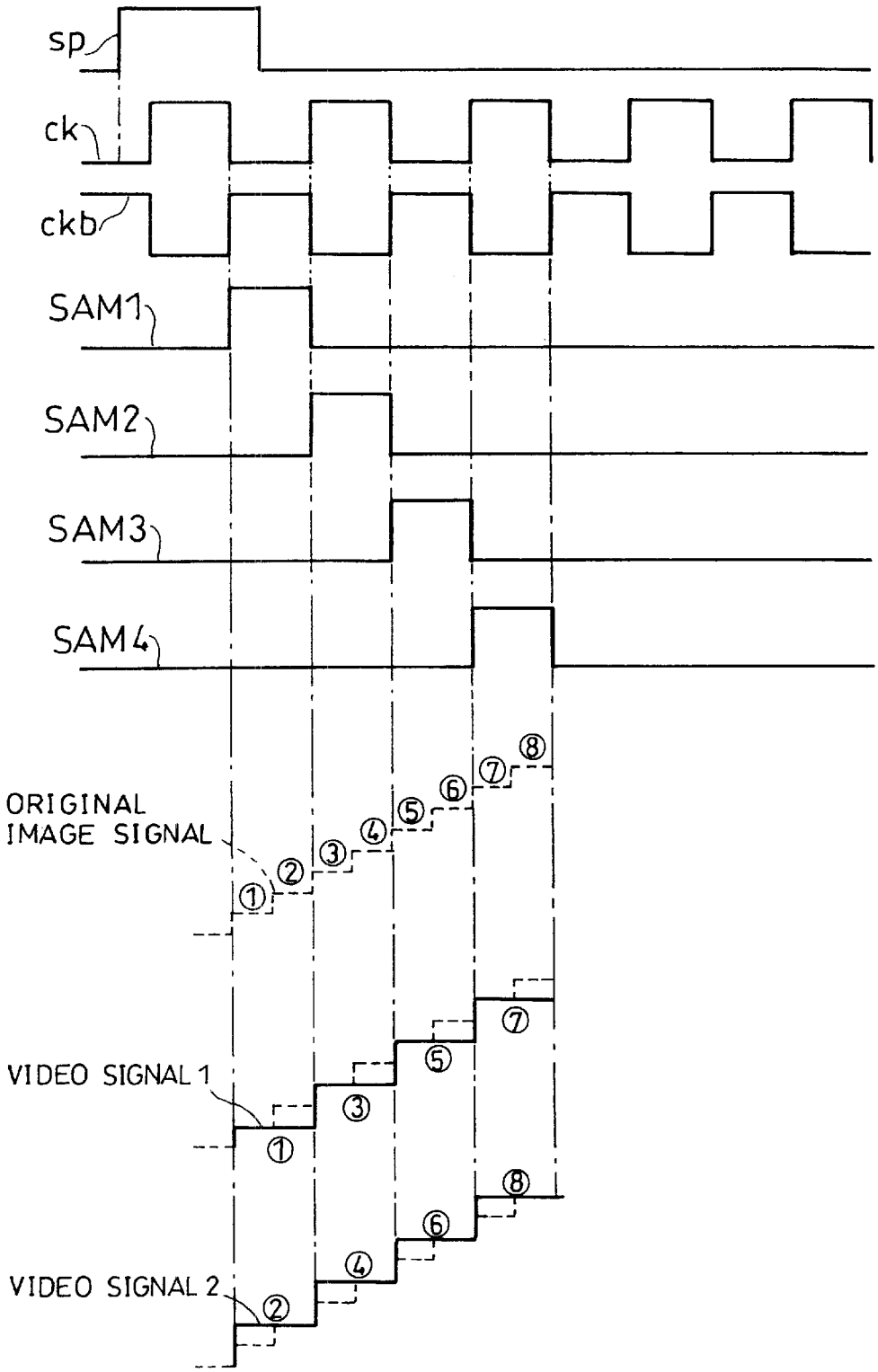
FIG. 8 PRIOR ART
FIG. 8 is a timing chart showing the operations of the data driver of the conventional liquid crystal display apparatus.
Figure 9:
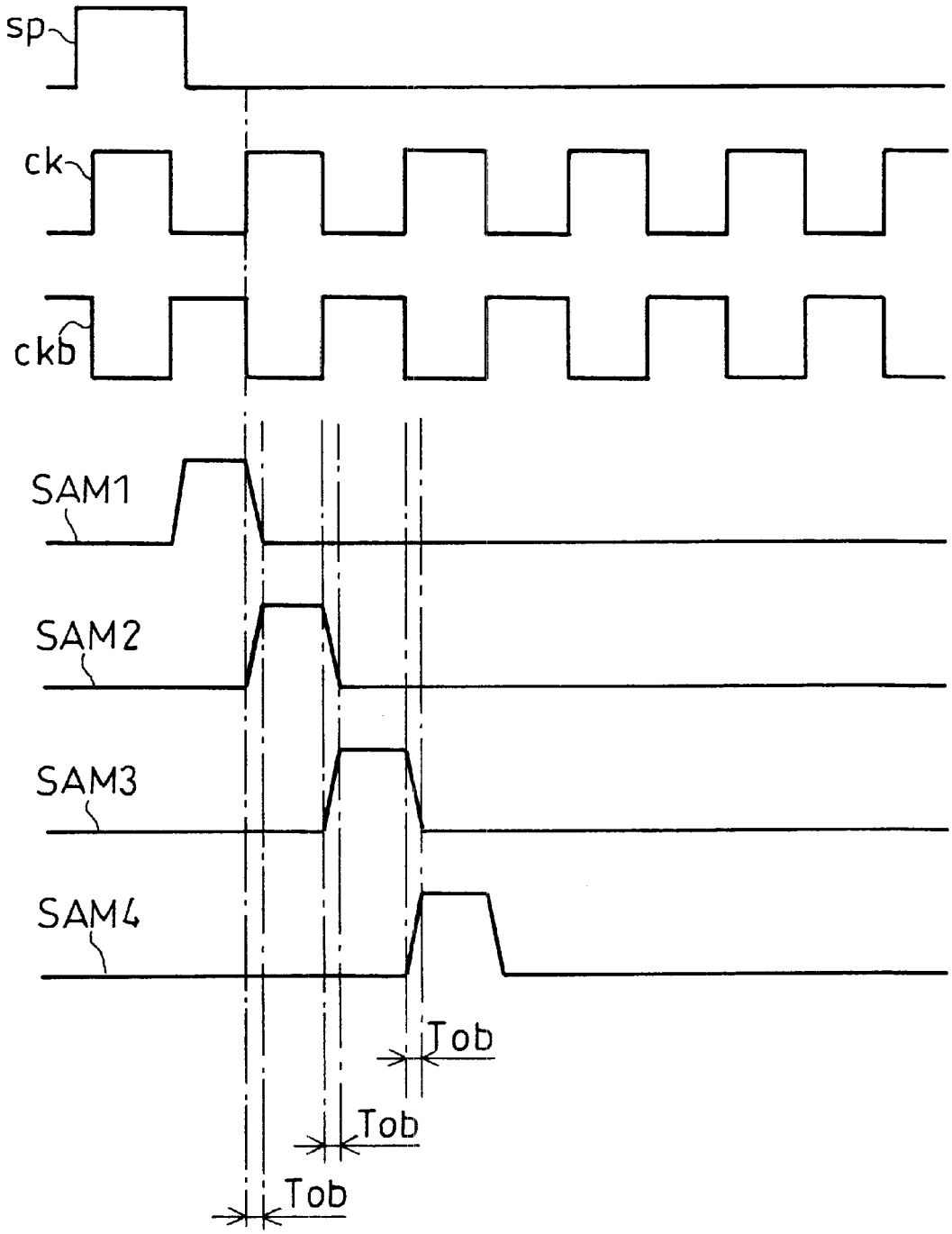
FIG. 9 PRIOR ART
FIG. 9 is an explanatory diagram showing the actual timings of the conventional liquid crystal display apparatus.
Figure 10:
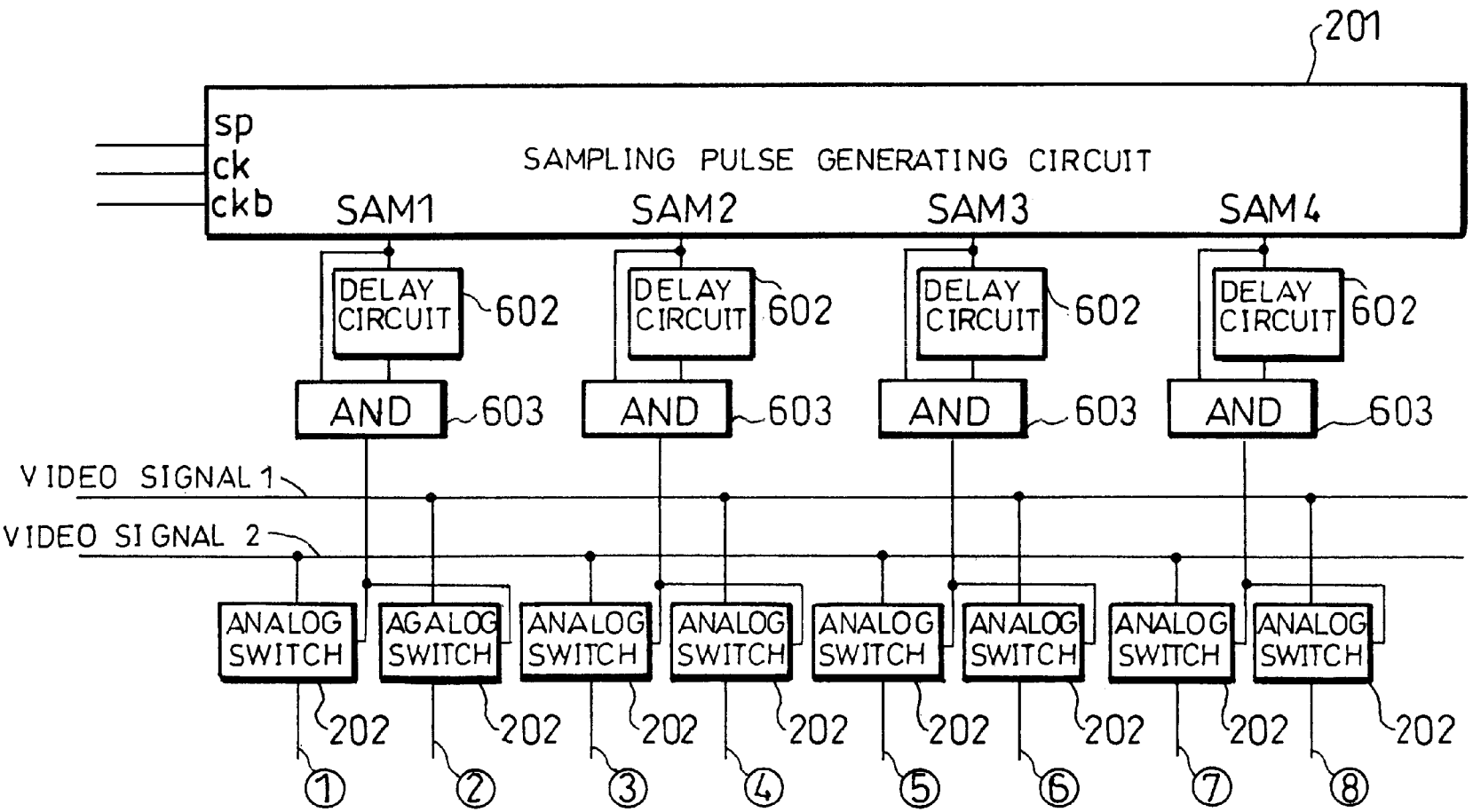
FIG.10 PRIOR ART
FIG. 10 is an explanatory diagram showing an example of the structure for narrowing the pulse width of a sampling pulse of the conventional liquid crystal display apparatus.
Figure 11:
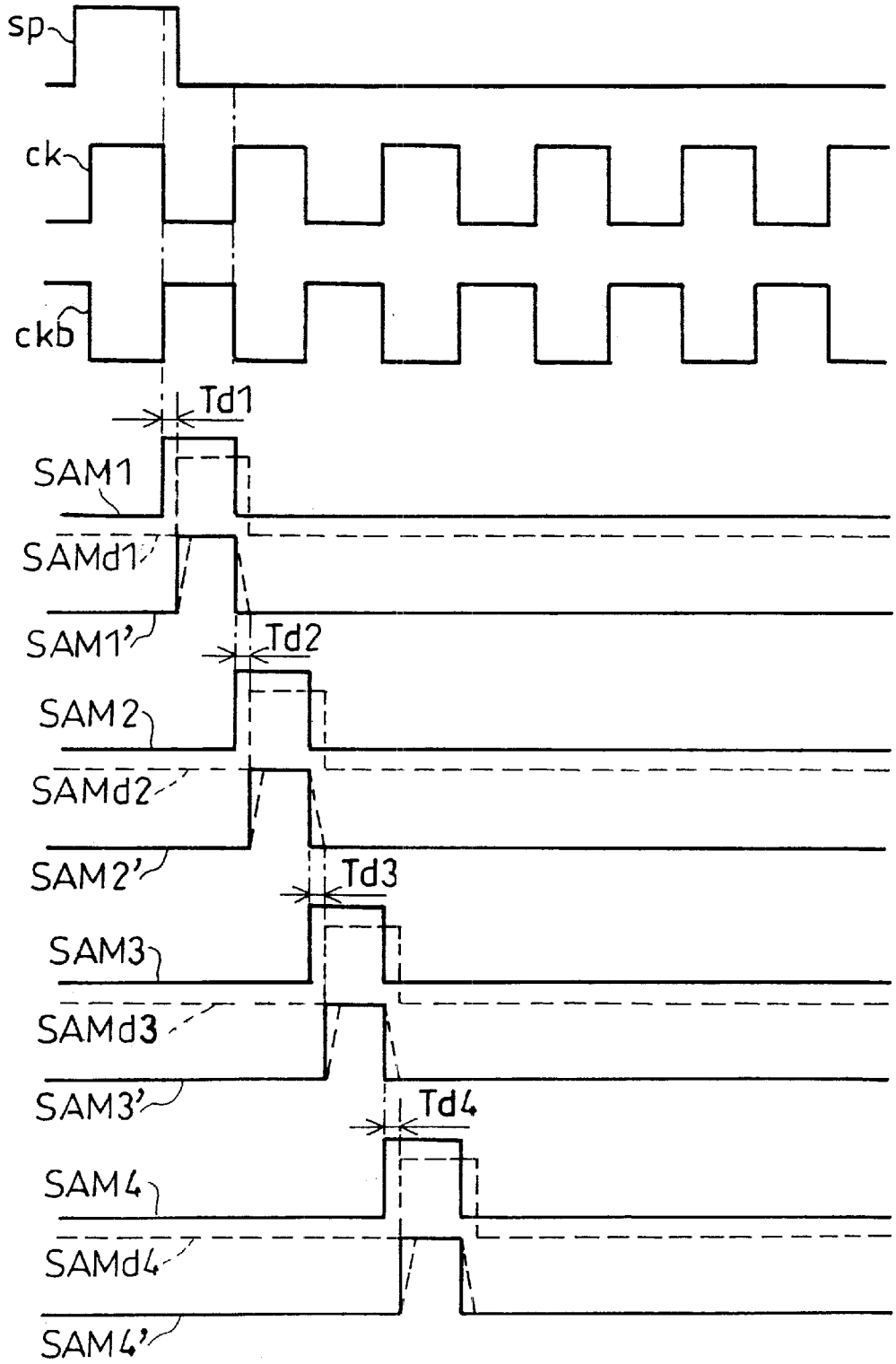
FIG. 11 PRIOR ART
FIG. 11 is a timing chart showing the operations of the liquid crystal display apparatus shown in FIG. 10.
Figure 12:
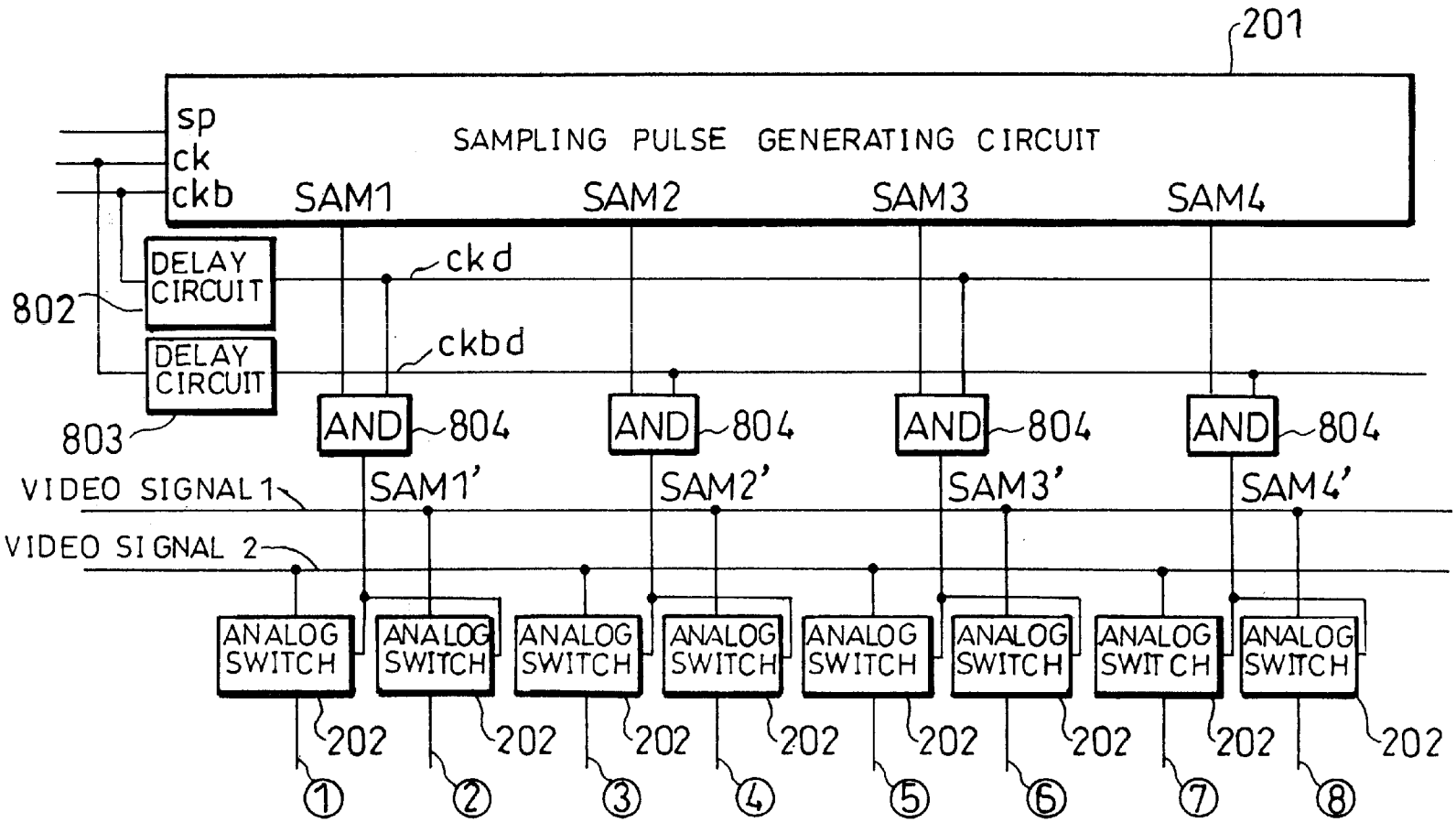
FIG. 12 PRIOR ART
FIG. 12 is an explanatory diagram showing another example of the structure for narrowing the pulse width of a sampling pulse of the conventional liquid crystal display apparatus.
Figure 13:
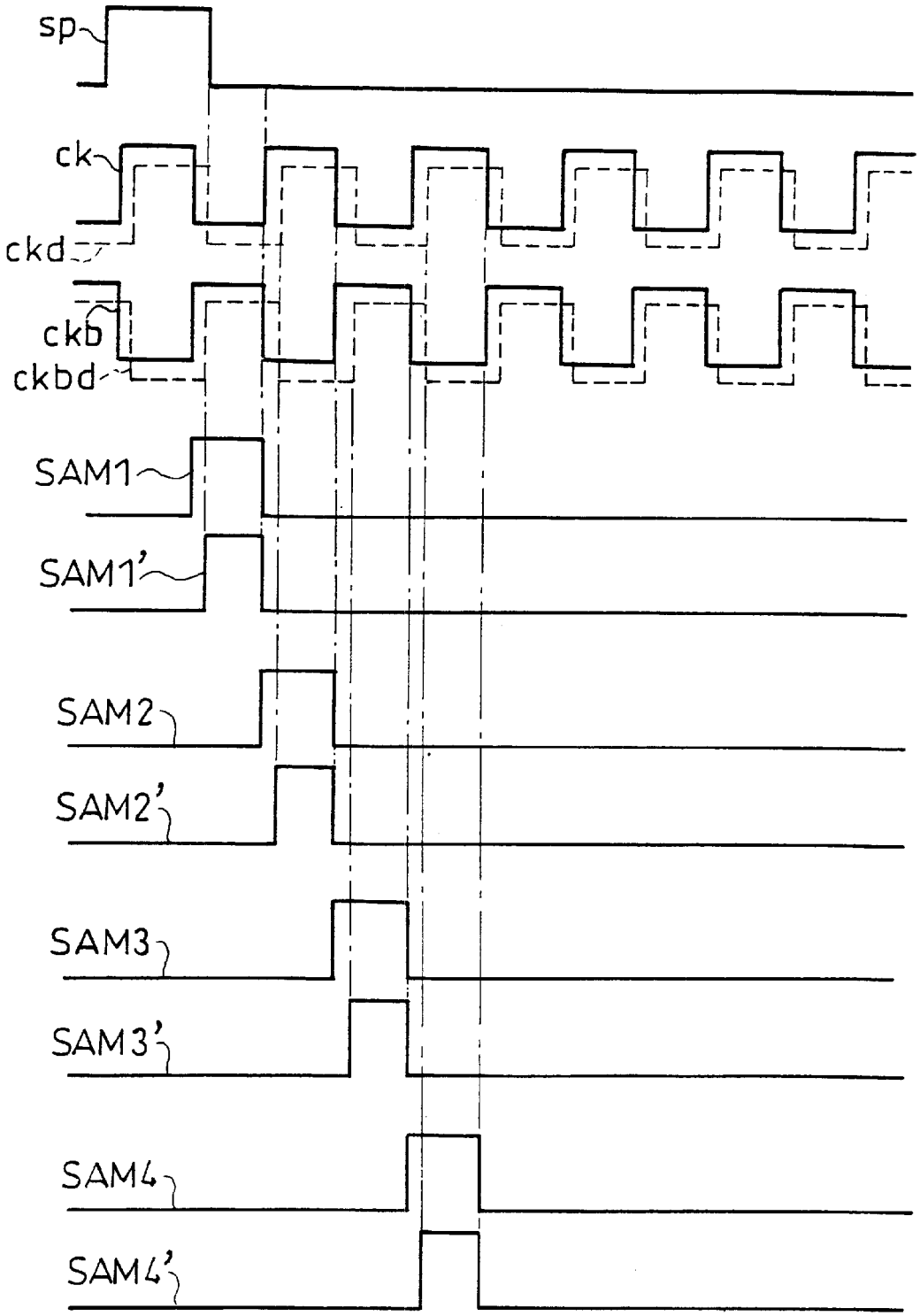
FIG. 13 is a timing chart showing the operations of the liquid crystal display apparatus shown in FIG. 12.

More specifically, according to the conventional sampling pulse generating circuit 301 using D-type flip-flops shown in FIG. 7, since the n-th stage output SAMn (sampling pulse) rises up in synchronization with the edge of the clock signal ck and falls down in synchronization with the edge of the clock signal ckb. Accordingly, when the duty ratio of the clock signal ck greatly differs from that of the clock signal ckb (for example, when the clock signal ckb rises up earlier than the clock signal ck falls down so that the Hi level duration of the clock signal ck overlaps with that of the clock signal ckb), it is not possible to appropriately carry out the operation.

In contrast, when the sampling pulse generating circuit 201 is constituted by the set-reset type flip-flop circuits 1101 like the present embodiment, it is not necessary that the falling down of the clock signal ckb coincides with the rising up of the clock signal ck and that the falling down of the clock signal ck coincides with the rising up of the clock signal ckb. This allows to freely vary the duty ratios of the respective clock signals ck and ckb, thereby ensuring to control the sampling pulse width. In another words, it is possible to realize the appropriate operation irrespective of the rising up and falling down of the clock signals ck and ckb, thereby ensuring that the sampling pulse width can be controlled by adjusting the duty ratios of the clock signals ck and ckb.

The above-mentioned liquid crystal display apparatus may be such as a driver monolithic-type liquid crystal display apparatus using polysilicon and a driver monolithic-type liquid crystal display apparatus using continuous grain crystal such as continuous grain crystal silicon that makes continuous crystal growth by using an element such as nickel which assists the crystal growth. In this case, it is possible to form a driver using polysilicon, having a smaller mobility than a single crystal silicon transistor, on a panel substrate, thereby reducing the cost in the packaging (mounting) step as compared with the case where an externally attached driver is used.

Figure 3:
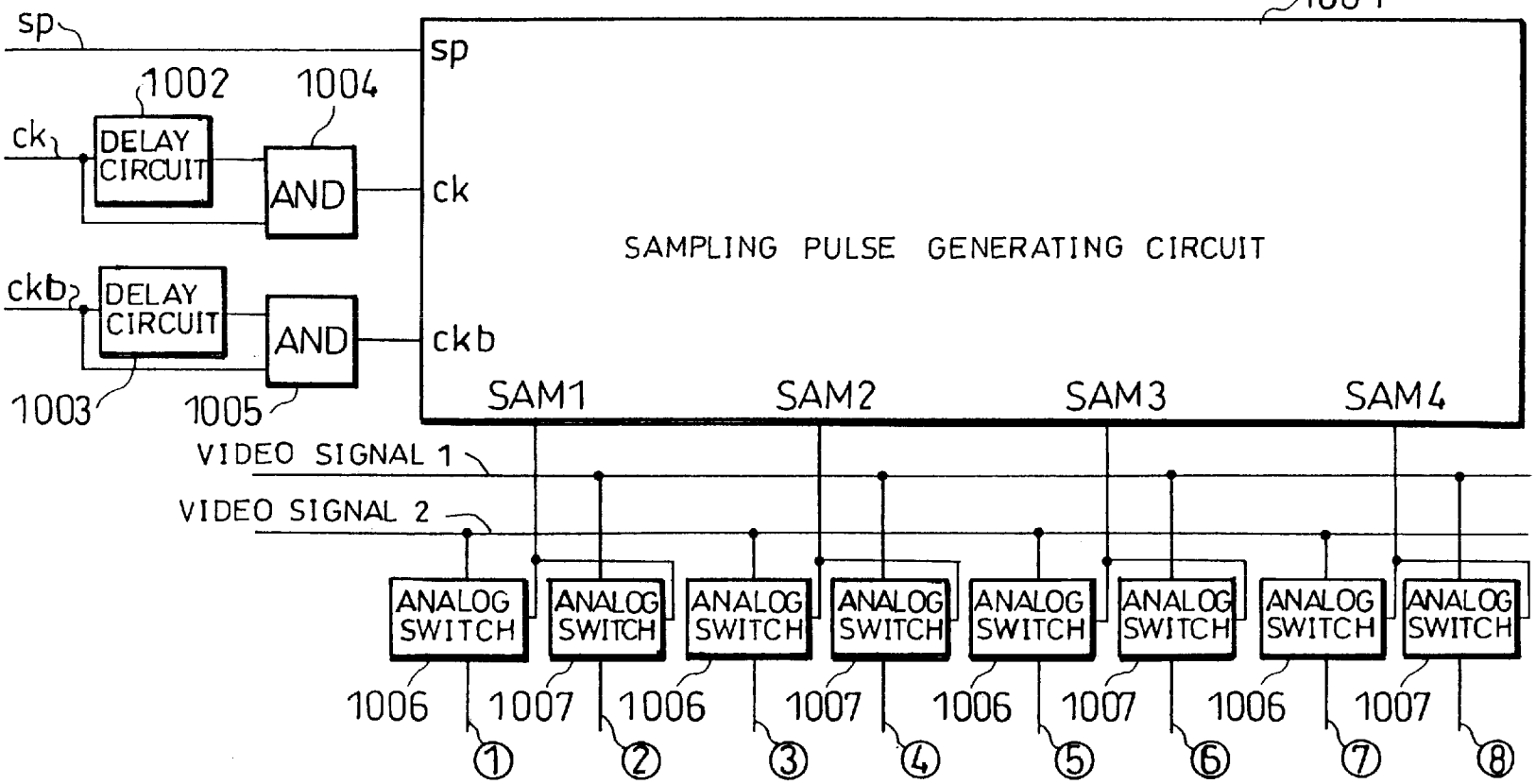
FIG. 3 is a schematic block diagram showing the structure of a data driver of another liquid crystal display apparatus in accordance with the present invention.

FIG. 3 shows an example of a structure of another data driver in accordance with the present invention. As shown in FIG. 3, the data driver is provided with a sampling pulse generating circuit 1001, delay circuits 1002 and 1003 that are provided in a clock signal input section of the sampling pulse generating circuit 1001, a logical operation circuit 1004 that conducts the operation of logical product with respect to the clock signal ck and the delayed clock signal ck that has been delayed by the delay circuit 1002, a logical operation circuit 1005 that conducts the operation of logical product with respect to the clock signal ckb and the delayed clock signal ckb that has been delayed by the delay circuit 1003, transmission lines (image signal wirings) for the video signals 1 and 2, and a plurality of analog switches 1006 and 1007 for sampling of an image signal supplied to the data driver in accordance with the sampling pulse. Note that since the sampling pulse generating circuit 1001 has the same structure as the structure shown in FIG. 1(*a*) (see FIG. 4(*a*)), the explanation of such a structure is omitted here.

As clear from FIG. 3, the difference between the data driver described here and the data driver described previously lies in that the delay circuits 1002 and 1003 and the logical operation circuits 1004 and 1005 are provided in the clock signal input section of the sampling pulse generating circuit 1001 so that the duty ratios of the respective driving clocks (the clock signals ck and ckb) supplied by an external liquid crystal apparatus driving circuit are adjusted in the data driver.

More specifically, according to the previously described data driver, the duty ratio of the clock signal for driving the sampling pulse generating circuit 201 is adjusted so as to avoid that the n-th stage output SAMn overlaps with the (n+1)-th stage output SAMn+1. When the duty ratio of the clock signal supplied to the liquid crystal display apparatus is thus adjusted by the external liquid crystal apparatus driving circuit, the extreme complication arises during generating the driving signal.

In contrast, according to the data driver having the structure shown in FIG. 3, the externally supplied clock signals ck and ckb have the same duty ratios of 50 percent as the conventional one. Namely, since the clock signal externally supplied to the delay circuits having the duty ratio of 50 percent can be used as the conventional one, it is ensured to realize a liquid crystal display having the superior compatibility with the conventional one.

Figure 4A:
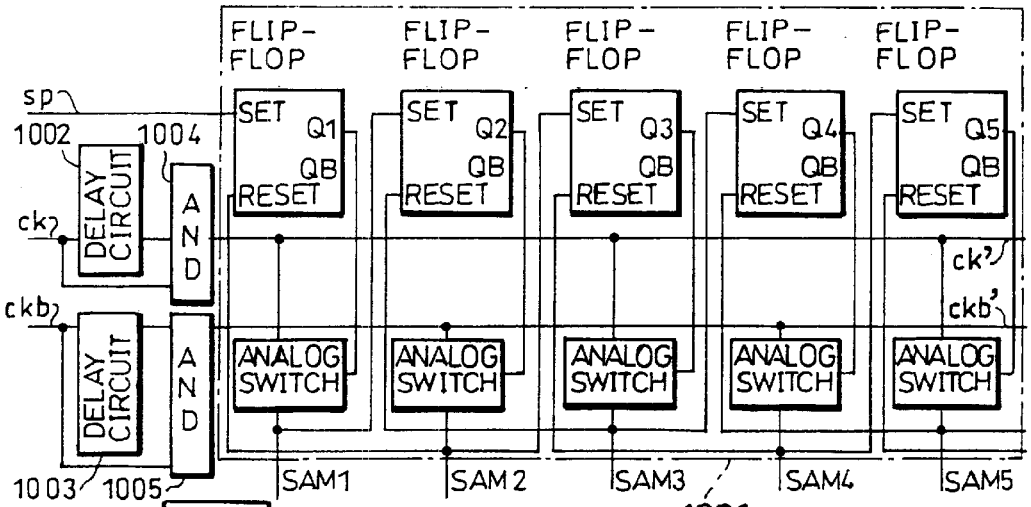
FIG. 4(*a*) is a schematic block diagram showing a sampling pulse generating circuit constituting the data driver of the liquid crystal display apparatus, and FIG. 4(*b*) is a timing chart showing the timings of the main portions of FIG. 4(*a*).
Figure 4B:
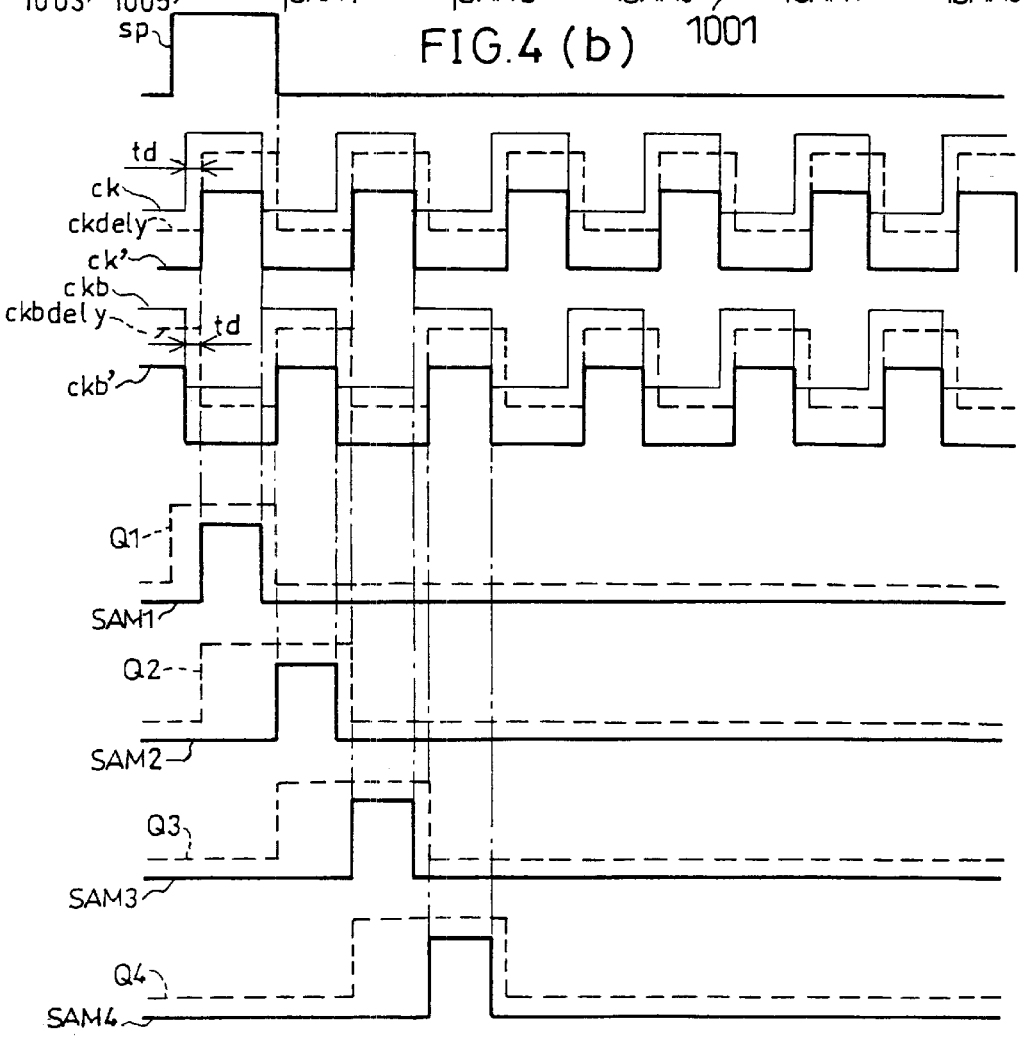
Figure 5:
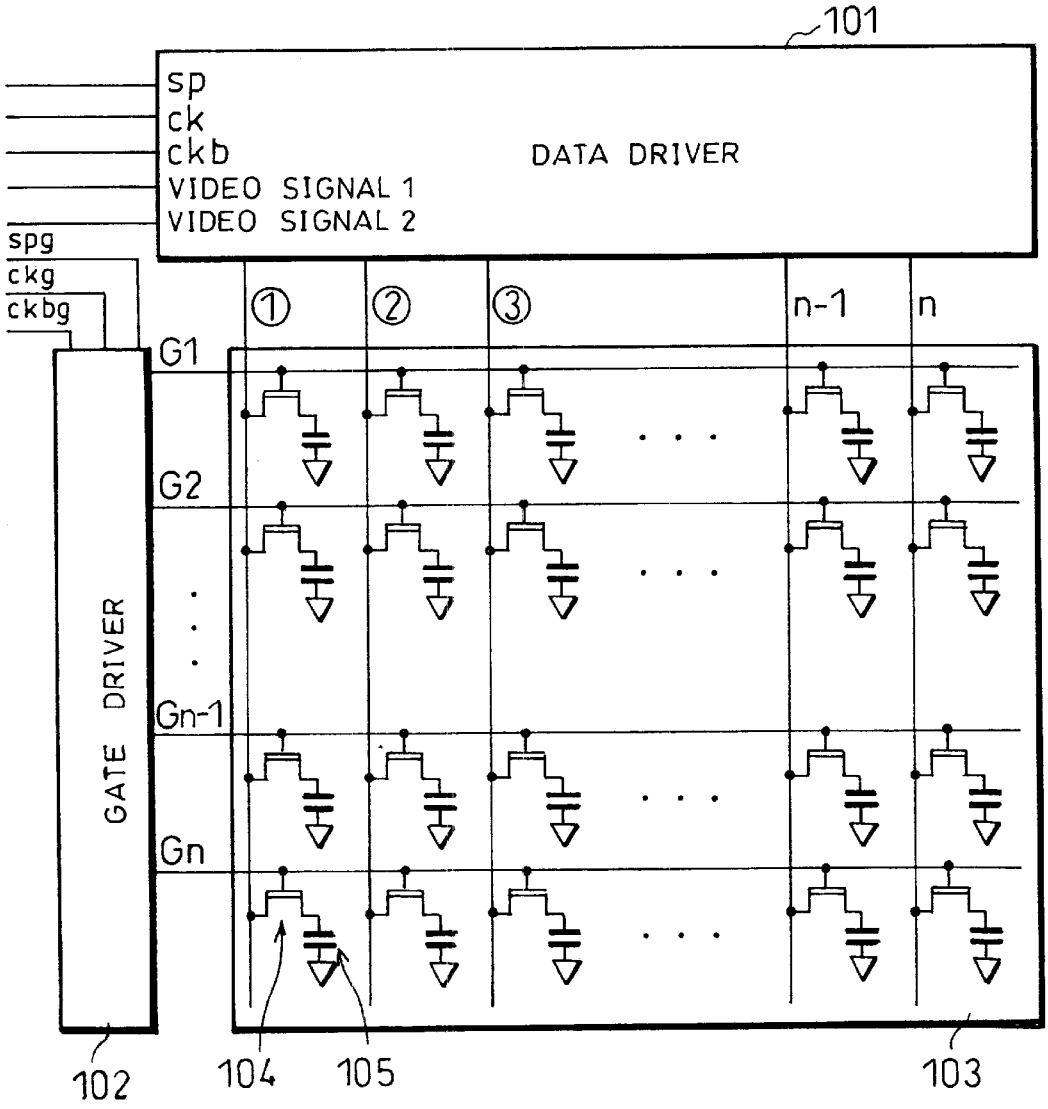
FIG. 5 PRIOR ART
FIG. 5 is an explanatory diagram showing a schematic structure of a conventional liquid crystal display apparatus.

Here, the following description deals with the operation of the sampling pulse generating circuit 1001 with reference to a timing chart shown in FIG. 4(*b*).

The clock signals ck and ckb supplied by the external liquid crystal display apparatus driving circuit have the respective duty ratios of 50 percent as shown in FIG. 4(*b*). The delay circuits 1002 and 1003 delays by time td the clock signals ck and ckb thus supplied and outputs delayed clock signals ckdely and ckbdely, respectively.

With respect to the clock signal ck and the delayed clock signal ckdely and with respect to the clock signal ckb and the delayed clock signal ckbdely, the respective logical product operation is carried out, thereby allowing to generate the clock signals ck' and ckb' that are adjusted so as to have the respective duty ratios in which the Hi level period is shorter than the Low level period. Similar to the foregoing sampling pulse generating circuit 201, it is possible to realize a sampling pulse generating circuit 1001 avoiding that the n-th stage output SAMn overlaps with the (n+1)-th stage output SAMn+1.

Note that the delay circuits 1002 and 1003 are not limited to a particular structure provided that a target delayed amount of time td can be obtained. For example, such a structure is realized by the arrangement in which a plurality of inverters having MOS structure such as CMOS, NMOS, and PMOS are series-connected or in which having capacitor and resistor form a CR integration circuit. Among the MOS structures, the CMOS structure is preferable because of capability of reducing the consumed current. Note also that the logical operation circuits 1004 and 1005 in accordance with the present embodiment may be arranged by logic circuits such as AND circuits, NAND circuits, OR circuits, and NOR circuits. For example, when realizing the logical operation circuit 1004 by the NAND circuits, the output of the NAND circuit is outputted as the clock signals ck' and ckb' through a buffer circuit constituted by an inverter (such an inverter can be realized by connecting the input terminals of the NAND circuit with each other) that reverses the logic level.

The liquid crystal display apparatus having the data driver shown in FIG. 3 may be such as a driver monolithic-type liquid crystal display apparatus using polysilicon and a driver monolithic-type liquid crystal display apparatus using continuous grain crystal such as continuous grain crystal silicon that makes continuous crystal growth by using an element such as nickel which assists the crystal growth. In this case, it is possible to form a driver using polysilicon, having a smaller mobility than a single crystal silicon transistor, on a panel substrate, thereby ensuring to reduce the cost in the packaging (mounting) step as compared with the case where an externally attached driver is used.

In the foregoing description, the image signal supplied to the data driver 101 is explained by using two-channel image data that are the image signals obtained by being subject to time base extension in which the original image signals are twice time-base-extended. In this case, it is possible to reduce the sampling speed of the image data to one half of the sampling of the original image signal.

More specifically, by making the image signal to the data driver 101 be subject to n-times time base extension so as to prepare and supply n-channel image data to the data driver 101, in accordance with transistor characteristics such as the mobility of a thin film transistor constituting the data driver 101, it is possible to sample at a time the n-channel image data in accordance with a single sampling pulse. Accordingly, it is possible to reduce the operation speed of the data driver to 1/n as compared with the case where the original image signal is sampled and is also possible to make monolithic a driver circuit constituting the liquid crystal display apparatus by thin film transistors made of such as polysilicon that has a smaller mobility than a single crystal silicon transistor.

The first driver monolithic-type liquid crystal display apparatus of the present invention, as has been described above, has a data driver for sampling an inputted image signal and is characterized in that the data driver includes a sampling pulse generating circuit for outputting a sampling pulse whose pulse width is controlled by a clock signal whose duty ratio of a high level period with respect to a low level period is less than 50 percent.

The second driver monolithic-type liquid crystal display apparatus of the present invention, as has been described above, in the arrangement of the first driver monolithic-type liquid crystal display apparatus, is characterized in that the sampling pulse generating circuit includes a shift register that is composed of set-reset type flip-flops whose set and reset are controlled by a clock signal supplied to the shift register.

The third driver monolithic-type liquid crystal display apparatus of the present invention, as has been described above, in the arrangement of the first or second driver monolithic-type liquid crystal display apparatus, is characterized in that n-channel image signal supplied to the data driver is sampled at a time in accordance with a single sampling pulse.

The fourth driver monolithic-type liquid crystal display apparatus of the present invention, as has been described above, in the arrangement of any one of the first through third driver monolithic-type liquid crystal display apparatus, is characterized in that the apparatus is formed by continuous grain crystal silicon that makes continuous crystal growth by using an element such as nickel which assists the crystal growth.

With any one of the arrangement of the first through fourth driver monolithic-type liquid crystal display apparatus, in the data driver including the sampling pulse generating circuit having a shift register that is composed of the set-reset type flip-flops, the duty ratio of the clock signal of a high level period with respect to a low level period is less than 50 percent, thereby avoiding adjoining sampling pulses of the respective stages of the sampling pulse generating circuit overlapping each other. Accordingly, the sampling of the image data is carried out with accurate timing so as to reduce the noise occurred during the sampling of the image data.

The fifth driver monolithic-type liquid crystal display apparatus of the present invention, as has been described above, is characterized in that the duty ratio of the clock signal is controlled by a logic circuit provided in the data driver in accordance with the inputted clock signal and a signal that is obtained by delaying the inputted clock signal by a delay circuit provided in the data driver signal.

It is preferable that the delay circuit is arranged so as to be constituted by a CMOS inverter circuit or an integration circuit having capacitor and resistor.

It is preferable that the logic circuit is arranged so as to be constituted by an AND circuit, a NAND circuit, an OR circuit, or a NOR circuit.

With the arrangement of the driver monolithic-type liquid crystal display apparatus, since the clock signal input section of the data driver is provided with the delay circuit and the logical product with respect to the clock signal and the delayed clock signal, it is possible to adjust the duty ratio of the clock signal for driving the shift register. Accordingly, the pulse width during the image data sampling is adjusted so that the adjoining sampling pulses for the respective data sampling do not overlap with each other, thereby ensuring that the shift register of the data driver is driven in accordance with the externally supplied clock signals, that drive the data driver, having the same duty ratios of 50 percent as the conventional one.

The liquid crystal display apparatus of the present invention, as has been described above, is characterized in that the sampling pulse generating circuit generates a sampling pulse having a pulse width that varies depending on the duty ratio of the clock signal.

With this arrangement of the liquid crystal display apparatus, the sampling pulse is generated by the sampling pulse generating circuit, the inputted signal to be displayed in accordance with the sampling pulse is sampled, and the sampling result is written into the display section as the display data so that the display section displays the inputted signal.

In the case where the duty ratio of the sampling pulse to be generated is fixed to 50 percent, when the wave form of the sampling pulse is blunt, there occurs the period in which the adjoining sampling pulses overlap with each other in the vicinity of the edges. In order to avoid this kind of deficiency, a variety of proposals have been proposed. However, all the proposals have their respective problems.

In contrast, according to the liquid crystal display apparatus of the present invention, the duty ratio of the clock signal of a high level period with respect to a low level period is less than 50 percent, thereby avoiding the adjoining sampling pulses, which are generated by the sampling pulse generating circuit, overlapping each other. Since the sampling of the inputted signal is carried out with accuracy, it is avoided that the sampling result has an error, thereby allowing accurate display data to be written into the display section. Accordingly, without making the circuit arrangement and operation control complicated, and without considering the driving ability of the delay circuit, a liquid crystal display apparatus with extremely high display reliability can be realized.

It is preferable that the sampling pulse generating circuit is constituted by (a) a shift register for shift operation having a plurality of set-reset type flip-flops in which a start pulse is supplied to a set terminal of the first stage flip-flop and (b) switching means provided for each of the flip-flops so that opening (i.e., turning off) and closing (i.e., turning on) of each switching means is controlled in response to each output of the respective stage flip-flops so that a sampling pulse, having a pulse width controlled in accordance with a duty ratio of the clock signal, is outputted during the opening, the sampling pulse being supplied to a set terminal of the next stage flip-flop and to a reset terminal of the previous stage flip-flop.

With the arrangement, the following shift operation is carried out by the shift register. More specifically, the output of the first stage flip-flop reaches a predetermined level when the start pulse is supplied to the set terminal. In response to the first stage flip-flop, the opening and closing of the first stage switching means is controlled. During the opening, the first stage switching means outputs a pulse, as the first stage sampling pulse, having the pulse width controlled in accordance with the duty ratio of the clock signal at that time.

The first stage sampling pulse (the output of the first stage switching means) is supplied to the set terminal of the second stage flip-flop. This allows the output of the second stage flip-flop to vary depending on the first stage sampling pulse, and the opening and closing of the second stage switching means is controlled in accordance with the output of the second stage flip-flop. During the opening, the second stage switching means outputs a pulse, as the second stage sampling pulse, having the pulse width controlled in accordance with the duty ratio of the clock signal at that time. The second stage sampling pulse is sent to the reset terminal of the first stage flip-flop. Accordingly, upon receipt of the second stage sampling pulse, the first stage flip-flop is reset. Thereafter, the operations similar to the foregoing ones are carried out by the third stage flip-flop and switching means as well as the respective following stage flip-flops and switching means.

When the sampling pulse generating circuit has the shift register composed of a plurality of D-type flip-flops that are cascade connected with each other like the conventional case, the n-th stage sampling pulse rises up and falls down in synchronization with the edge of the clock signal. Accordingly, there are some duty ratios that cause the adjoining sampling pulses to overlap with each other in the vicinity of the edges and cause inadequate operation.

In contrast, when the sampling pulse generating circuit is provided with the set-reset type flip-flops, it is possible to operate with accuracy irrespective of the rising edge and falling edge. Accordingly, the adjustment of the pulse width of the sampling pulse can be made by controlling so that the duty ratio of a Hi level period with respect to Low level period is less than 50 percent. Namely, the rising-up and falling-down of the sampling pulse can be freely controlled in accordance with the duty ratio of the clock signal. Accordingly, it is ensured to avoid that the adjoining sampling pulses overlap with each other in the vicinity of the edges and such an overlapping gives rise to the inadequate operation.

It is preferable that the inputted signal is such that the image signal is subject to n-times time base extension so as to prepare and supply n-channel image data and these n-channel image data are sampled in accordance with a single sampling pulse at a time. When the inputted image signal is subject to n-times time base extension so as to prepare and supply n-channel image data and these n-channel image data are sampled in accordance with a single sampling pulse at a time, it is possible to reduce the operation speed of the data driver to 1/n as compared with the case where the original image signal is sampled and is also possible to make monolithic a driver circuit constituting the liquid crystal display apparatus by thin film transistor made of such as polysilicon that has smaller mobility than a single crystal silicon transistor.

It is preferable that the above-mentioned liquid crystal display apparatus is a driver monolithic-type liquid crystal display apparatus using continuous grain crystal that makes continuous crystal growth by using an element which assists the crystal growth. In this case, it is possible to use a crystal having a smaller mobility than a single crystal silicon transistor, thereby ensuring to reduce the cost.

The liquid crystal display apparatus is characterized by further having a delay circuit for delaying the clock signal, and a logic operation circuit for carrying out operation of logical product with respect to the the clock signal and a delayed signal outputted from the delay circuit, and the sampling pulse generating circuit generates the sampling pulse in response to the logic operation circuit.

With the liquid crystal display apparatus, the delayed clock signal that has been delayed by the delay circuit and the clock signal that has not yet been delayed are inputted to the logic operation circuit in which the operation of logical product is carried out with respect to the inputted two clock signals. By the operation of logical product, the duty ratio of the clock signals become reduced. By using the clock signals whose duty ratio is thus reduced, it is possible to avoid that the adjoining sampling pulses generated by the sampling pulse generating circuit overlap with each other. With the arrangement, since the sampling of the inputted signal is carried out with accuracy, it can be avoided that the sampling result contains an error, thereby ensuring that the accurate display data is written into the display section. Accordingly, without making the circuit arrangement and operation control complicated, and without the necessity that the delay circuit should have the driving ability in accordance with the number of the sampling pulses, it is ensured to realize a liquid crystal display apparatus with extremely high display reliability.

Thus, it is possible to obtain the target duty ratio with ease without making the circuit arrangement and operation control complicated, as well as without making the duty ratio small on the side of the external liquid crystal display apparatus driving circuit. Furthermore, since the clock signal externally supplied to the delay circuits having the duty ratio of 50 percent can be used like the conventional one, it is ensured to realize a liquid crystal display having the superior compatibility with the conventional one.

It is preferable that the delay circuit is arranged so as to be constituted by a MOS inverter circuit or an integration circuit having capacitor and resistor. With the arrangement, it is possible to realize a delay circuit with a simple structure. Among the MOS circuits, the CMOS structure is preferable because of capability of reducing the consumed current.

A data driver in accordance with the present invention, as has been described above, is characterized in that the sampling pulse generating circuit generates the sampling pulse in accordance with the clock signal whose duty ratio of a high level period with respect to a low level period is less than 50 percent.

With the arrangement of the data driver, the sampling pulse is generated by the sampling pulse generating circuit, and the inputted signal is sampled in accordance with the sampling pulse, thereafter the sampling result is outputted as the display data.

In the case where the duty ratio of the sampling pulse to be generated is fixed to 50 percent, when the wave form of the sampling pulse is blunt, there occurs the period in which the adjoining sampling pulses overlap with each other in the vicinity of the edges. In order to avoid the deficiency, a variety of proposals have been proposed. However, all the proposals have their respective problems.

In contrast, according to the data driver of the present invention, the duty ratio of the clock signal of a high level period with respect to a low level period is less than 50 percent, thereby avoiding the adjoining sampling pulses which are generated by the sampling pulse generating circuit overlapping each other. Since the sampling of the inputted signal is carried out with accuracy, it is avoided that the sampling result has an error, thereby allowing accurate display data to be written into the display section. Accordingly, without making the circuit arrangement and operation control complicated, and without considering the driving ability of the delay circuit, a liquid crystal display apparatus with extremely high display reliability can be realized.

It is preferable that the sampling pulse generating circuit is constituted by (1) a shift register for shift operation having a plurality of set-reset type flip-flops in which a start pulse is supplied to a set terminal of the first stage flip-flop and (2) switching means provided for each of the flip-flops so that opening (turning off) and closing (turning on) of each switching means is controlled in response to each output of the respective stage flip-flops so that a sampling pulse, having a pulse width controlled in accordance with a duty ratio of the clock signal, is outputted during the opening, the sampling pulse being supplied to a set terminal of the next stage flip-flop and to a reset terminal of the previous stage flip-flop.

With the arrangement, the following shift operation is carried out by the shift register. More specifically, the output of the first stage flip-flop reaches a predetermined level when the start pulse is supplied to the set terminal. In response to the first stage flip-flop, the opening and closing of the first stage switching means is controlled. During the opening, the first stage switching means outputs a pulse, as the first stage sampling pulse, having the pulse width controlled in accordance with the duty ratio of the clock signal at that time.

The first stage sampling pulse (the output of the first stage switching means) is supplied to the set terminal of the second stage flip-flop. This allows the output of the second stage flip-flop to vary depending on the first stage sampling pulse, and the opening and closing of the second stage switching means is controlled in accordance with the output of the second stage flip-flop. During the opening, the second stage switching means outputs a pulse, as the second stage sampling pulse, having the pulse width controlled in accordance with the duty ratio of the clock signal at that time. The second stage sampling pulse is sent to the reset terminal of the first stage flip-flop. Accordingly, upon receipt of the second stage sampling pulse, the first stage flip-flop is reset. Thereafter, the operations similar to the foregoing ones are carried out by the third stage flip-flop and switching means and the respective following stage flip-flops and switching means.

When the sampling pulse generating circuit has the shift register composed of a plurality of D-type flip-flops that are cascade connected with each other like the conventional case, the n-th stage sampling pulse rises up and falls down in synchronization with the edge of the clock signal. Accordingly, there are some duty ratios that cause the adjoining sampling pulses to overlap with each other in the vicinity of the edges and cause inadequate operation.

In contrast, when the sampling pulse generating circuit is provided with the set-reset type flip-flops, it is possible to operate with accuracy irrespective of the rising edge and falling edge. Accordingly, the adjustment of the pulse width of the sampling pulse can be made by controlling so that the duty ratio of a Hi level period with respect to Low level period is less than 50 percent. Namely, the rising-up and falling-down of the sampling pulse can be freely controlled in accordance with the duty ratio of the clock signal. Accordingly, it is ensured to avoid that the adjoining sampling pulses overlap with each other in the vicinity of the edges and such an overlapping gives rise to the inadequate operation.

It is preferable that the above-mentioned data driver further includes a delay circuit for delaying the clock signal, and a logic operation circuit for carrying out operation of logical product with respect to the the clock signal and a delayed signal outputted from the delay circuit, and the sampling pulse generating circuit generates the sampling pulse in response to the logic operation circuit.

With the data driver, the delayed clock signal that has been delayed by the delay circuit and the clock signal that has not yet been delayed are inputted to the logic operation circuit in which the operation of logical product is carried out with respect to the inputted two clock signals. By the operation of logical product, the duty ratio of the clock signals becomes reduced. By using the clock signals whose duty ratio is thus reduced, it is possible to avoid the adjoining sampling pulses generated by the sampling pulse generating circuit overlapping each other. With the arrangement, since the sampling of the inputted signal is carried out with accuracy, it can be avoided that the sampling result contains an error, thereby ensuring that accurate display data is written into the display section. Accordingly, without making the circuit arrangement and operation control complicated, and without the necessity that the delay circuit should have the driving ability in accordance with the number of the sampling pulses, delayed a data driver with extremely high display reliability can be realized.

Thus, it is possible to obtain the target duty ratio with ease without making the circuit arrangement and operation control complicated, as well as without making the duty ratio small on the side of the external liquid crystal display apparatus driving circuit. Furthermore, since the clock signal externally supplied to the delay circuits having the duty ratio of 50 percent can be used like the conventional one, it is ensured to realize a data driver having the superior compatibility with the conventional one.

There are described above novel features which the skilled man will appreciate give rise to advantages. These are each independent aspects of the invention to be covered by the present application, irrespective of whether or not they are included within the scope of the following claims.

What is claimed is:

1. A liquid crystal display apparatus comprising a sampling pulse generating circuit for generating a plurality of sampling pulses that carry out sampling of inputted signal, in which the inputted signal is sampled in accordance with the sampling pulses so as to be written into a display section as a display data, wherein the sampling pulse generating circuit includes:

a shift register, for shift operation, having a plurality of set-reset type flip-flops in which a start pulse is supplied to a set terminal of a first stage flip-flop, and switching means provided for each of the flip-flops so that opening and closing of said each switching means is controlled in response to each output of the respective stage flip-flops so that a sampling pulse, having a pulse width controlled in accordance with the duty ratio of the clock signal, is outputted during the opening the sampling pulse being supplied to a set terminal of a next stage flip-flop and to a reset terminal of a previous stage flip-flop; and wherein the sampling pulse generating circuit receives a clock signal whose duty ratio of a high level period with respect to a low level period is less than 50 percent, and generates the sampling pulse in accordance with the clock signal.

2. The liquid crystal display apparatus as set forth in claim 1, wherein the inputted signal is such that an image signal is subject to n-times time base extension so as to prepare and supply n-channel image data and these n-channel image data are sampled in accordance with a single sampling pulse at a time.

3. The liquid crystal display apparatus as set forth in claim 1, wherein the liquid crystal display apparatus is a driver monolithic-type liquid crystal display apparatus which is formed by continuous grain crystal that makes continuous crystal growth by using an element for assisting crystal growth.

4. The liquid crystal display apparatus as set forth in claim 1, further comprising:

a delay circuit for delaying the clock signal; and a logic operation circuit for carrying out operation of logical product with respect to the the clock signal and a delayed signal outputted from the delay circuit, wherein the sampling pulse generating circuit generates the sampling pulse in response to the logic operation circuit.

5. The liquid crystal display apparatus as set forth in claim 4, wherein the delay circuit is composed of a MOS circuit.

6. The liquid crystal display apparatus as set forth in claim 4, wherein the delay circuit is composed of an integration circuit.

7. The liquid crystal display apparatus as set forth in claim 1, wherein the clock signal includes (i) a first clock signal (ck) and (ii) a second clock signal (ckb), which is in a reverse phase of the first clock signal (ck), and a time duration (ts) is provided between a Hi level duration of the first clock signal (ck) and a Hi level duration of the clock signal (ckb).

8. A data driver comprising a sampling pulse generating circuit for generating a plurality of sampling pulses that carry out sampling of inputted signal, in which the inputted signal is sampled in accordance with the sampling pulses so as to be outputted as a display data, wherein the sampling pulse generating circuit include:

a shift register for shift operation having a plurality of set-reset type flip-flops in which a start pulse is supplied to a set terminal of a first stage flip-flip, and switching means provided for each of the flip-flops so that opening and closing of said each switching means is controlled in response to each output of the respective stage flip-flops so that a sampling pulse having a pulse width controlled in accordance with the duty ratio of the clock signal, is outputted during the opening, the sampling pulse being supplied to a set terminal of a next stage flip-flop and to a reset terminal of a previous stage flip-flop; and wherein the sampling pulse generating circuit receives a clock signal whose duty ratio of a high level period with respect to a low level period is less than 50 percent, and generates the sampling pulse in accordance with the clock signal.

9. The data driver as set forth in claim 8, further comprising:

a delay circuit for delaying the clock signal; and a logic operation circuit for carrying out operation of logical product with respect to the the clock signal and a delayed signal outputted from the delay circuit, wherein the sampling pulse generating circuit generates the sampling pulse in response to the logic operation circuit.

10. The data driver as set forth in claim 8, wherein the clock signal includes (i) a first clock signal (ck) and (ii) a second clock signal (ckb), which is in a reverse phase of the first clock signal (ck), and a time duration (ts) is provided between a Hi level duration of the first clock signal (ck) and a Hi level duration of the clock signal (ckb).

* * * * *